US009976366B2

(12) United States Patent
Calderoni

(10) Patent No.: US 9,976,366 B2
(45) Date of Patent: May 22, 2018

(54) VALVE ASSEMBLY FOR DRILLING MUD CIRCULATION AND ASSOCIATED DRILLING ELEMENTS

(71) Applicant: DRILLMEC SPA, Gariga di Podenzano (IT)

(72) Inventor: Angelo Calderoni, Gariga di Podenzano (IT)

(73) Assignee: DRILLMEC SPA, Gariga Di Podenzano (PC) (IT)

( * ) Notice: Subject to any disclaimer, the term of this patent is extended or adjusted under 35 U.S.C. 154(b) by 110 days.

(21) Appl. No.: 14/916,262

(22) PCT Filed: Sep. 1, 2014

(86) PCT No.: PCT/IB2014/064169
§ 371 (c)(1),
(2) Date: Mar. 3, 2016

(87) PCT Pub. No.: WO2015/033260
PCT Pub. Date: Mar. 12, 2015

(65) Prior Publication Data

US 2016/0222742 A1 Aug. 4, 2016

(30) Foreign Application Priority Data

Sep. 6, 2013 (IT) ..... TO2013A0722

(51) Int. Cl.
*E21B 21/10* (2006.01)
*E21B 21/08* (2006.01)

(52) U.S. Cl.
CPC ..... *E21B 21/10* (2013.01); *E21B 21/08* (2013.01); *E21B 21/103* (2013.01); *E21B 21/106* (2013.01)

(58) Field of Classification Search
CPC ..... E21B 21/10; E21B 21/103; E21B 21/12; E21B 21/08; E21B 2034/005
See application file for complete search history.

(56) References Cited

U.S. PATENT DOCUMENTS 3,298,385 A 1/1967 Jackson et al.
2006/0278434 A1 12/2006 Calderoni et al.
(Continued)

FOREIGN PATENT DOCUMENTS

CA 2540956 A1 9/2007
WO 2014/027317 A2 2/2014
(Continued)

OTHER PUBLICATIONS

International Search Report and Written Opinion from International Application No. PCT/IB2014/064169, dated May 4, 2015.
(Continued)

*Primary Examiner* — D. Andrews
*Assistant Examiner* — Jonathan Malikasim
(74) *Attorney, Agent, or Firm* — Merchant & Gould P.C.

(57) ABSTRACT

A valve assembly is for selectively opening and closing a radial aperture provided on a drilling element for drilling mud circulation. The valve assembly includes a valve body that has an inlet aperture and an outlet aperture, and a duct for putting the apertures in communication with each other, thereby defining a mud path (p). The valve assembly includes at least two shutters arranged in a cascade along the direction of the mud path (p), thus forming at least a double barrier.

9 Claims, 13 Drawing Sheets

(56) References Cited

U.S. PATENT DOCUMENTS

| | | | |
|---|---|---|---|
| 2010/0096190 | A1 | 4/2010 | Younger et al. |
| 2011/0203670 | A1 | 8/2011 | Braddick |
| 2012/0018229 | A1 | 1/2012 | Leuchtenberg et al. |

FOREIGN PATENT DOCUMENTS

| | | | |
|---|---|---|---|
| WO | 2014/135873 | A2 | 9/2014 |
| WO | 2014/203153 | A1 | 12/2014 |

OTHER PUBLICATIONS

International Preliminary Report on Patentability from International Application No. PCT/IB2014/064169, dated Oct. 6, 2015.

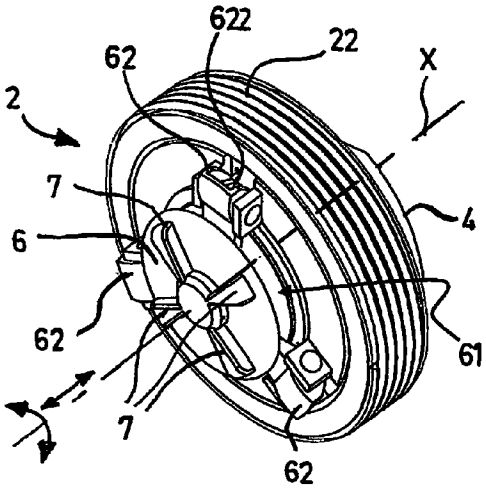
Fig. 1A
Fig. 1B
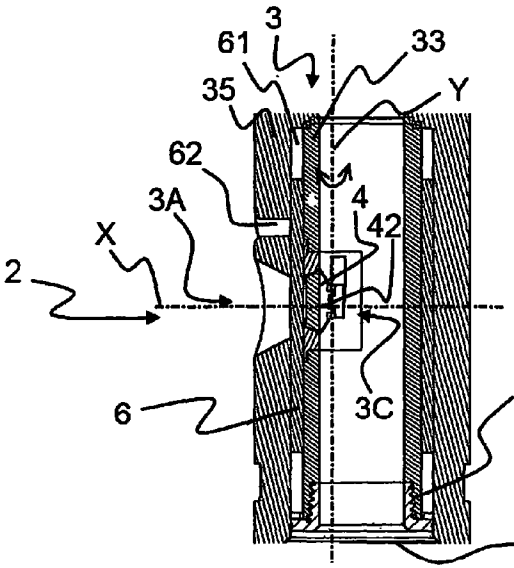
Fig.1C sez. A-A

VALVE ASSEMBLY FOR DRILLING MUD CIRCULATION AND ASSOCIATED DRILLING ELEMENTS

This application is a National Stage Application of International Application No. PCT/IB2014/064169, filed 1 Sep. 2014, which claims benefit of Serial No. TO2013A000722, filed 6 Sep. 2013 in Italy and which applications are incorporated herein by reference. To the extent appropriate, a claim of priority is made to each of the above disclosed applications.

The present invention relates to a valve assembly for drilling mud circulation and to drilling elements, such as, for example, a drill pipe, a tool joint, a sub, with which said valve assembly can be associated.

Said valve assembly is adapted to be associated with a radial aperture in hydraulic communication with an axial duct comprised in the drilling elements with which said valve assembly is associated. The valve assembly according to the present invention comprises at least two radial valves for creating a double barrier for closing a radial aperture during all wellbore drilling steps.

It is known to those skilled in the art that drilling mud has to be circulated through a drill bit located at the end of a series of drilling elements, at the bottom of the well of in proximity thereto, also during the steps of inserting or removing the drill pipes, for the purpose of preventing the uncovered hole from being damaged. In fact, pressure variations that occur at the bottom, which are due to the fact that the pump is in operation while drilling and is then turned off for inserting or removing the pipes, may cause landslides and/or entry of fluids into the wellbore. Circulation of the mud through the bit during the steps of inserting or removing the pipes takes place thanks to a drilling element that, in addition to comprising a through hole extending along the longitudinal axis, also comprises a radial aperture that allows drilling mud to flow in when it cannot be directly pumped through the longitudinal hole. This problem is particularly felt for critical wells, such as, for example, deep, deviated, horizontal and extended-reach wells.

For better performance and operational safety, it is in fact necessary to keep the well bottom pressure constant at desired levels.

Prior-art drilling elements comprise safety valves or valve assemblies that both ensure the necessary safety during the various operating steps and appropriately direct the mud flows to avoid undesired backflows.

Drilling elements are known which comprise valve assemblies wherein a single-barrier valve is arranged at the radial aperture, and a further axial valve is arranged in correspondence to the through hole of the drilling element itself. In addition, in order to ensure that the radial aperture is closed properly, in particular during the drilling steps, a removable plug is inserted in correspondence to the radial aperture. Said removable plug is fixed into a suitable threaded seat comprised in the inner wall of the radial aperture, upstream of said safety valve with respect to the direction of the mud flow entering through said radial aperture. One example of such a drilling element is illustrated in patent document U.S. Pat. No. 3,298,385.

It is known that, during the steps of removing or inserting one or more drill pipes, the radial valve follows the following operating sequence:

a) the radial valve stays closed until the pipe to which the valve is connected is wedged into the drill floor and is locked for adding or removing a series of drilling elements, commonly referred to as drill length;

b) after unscrewing and removing the removable safety plug, the radial valve is connected to the manifold, which is fed by the mud pump, and is supplied to allow mud circulation in the well bottom;

c) at the end of the circulation step that involves it, and after a series of drilling elements or drill length has been added or removed, the radial valve is closed again and, before it is extracted or lowered into the well, the removable safety plug is screwed in again to prevent any mud from leaking through the radial through hole comprised in the drilling element.

The radial aperture is located at such a height as to be easily accessible to an operator. This means that an undesired leak of high-pressure drilling mud through said radial aperture will be directed towards the operators, thus being dangerous.

The above-mentioned patent document does not provide a double barrier in correspondence to the radial aperture during the pipe insertion and removal step, which step requires the presence of operators near the working area. This partial lack of protection arises right after the removable safety plug has been removed, and this may cause important safety problems for the people working in proximity to the valve during the steps of opening and closing the radial aperture. As a matter of fact, following the removal of the safety plug the radial aperture is only kept closed by one shutter. Should said radial valve fail, undesired leakage of mud might occur, causing considerable problems. The lack of safety of such devices is due to the very necessity of removing the protection plug and relying for an indefinite period of time on the radial valve alone for keeping said aperture closed, with circulation pressures that may be in excess of 34474 kpa or even close to 51711 kpa. In such a situation, there will only be one radial valve to prevent an undesired leakage of drilling mud in a direction that might be dangerous for the operators working on the drill floor, near the drill pipes.

Normally said radial valve is a flap valve, which, in case of failure, will not be able to hermetically seal the radial aperture, through which mud could exit due to the pressures involved.

From patent application US2011203670 valve elements are also known which comprise a spherical valve that includes more than one through holes formed inside the spherical shutter, so that it is possible to selectively close and open the radial aperture and the axial longitudinal hole of the drilling element with which said valve element is associated.

From a purely theoretical viewpoint, such a solution appears to be safer than the above-discussed case, but in practice, due to the use of a spherical valve, it does not ensure proper closing and opening of both the radial aperture and the axial longitudinal hole of the drilling element, especially when high pressures are involved.

The present invention aims at solving the above-described technical problems by providing a valve assembly for selectively opening and closing a radial aperture on a drilling element at operating pressures up to 51711 kpa, which provides a double barrier in any operating condition of the drilling rig, thus improving safety during the various operating steps, especially during the steps of inserting and removing drill pipes.

One aspect of the present invention relates to a valve assembly comprising two barriers.

A further aspect of the present invention relates to a drilling element comprising a valve assembly according to the present invention.

The features and advantages of the valve assembly and of the drilling element with which it is associated will become apparent from the following exemplificative and non-limiting description of several equivalent embodiments thereof and from the annexed drawings, wherein:

FIGS. 1A, 1B and 1C show different views of the three exemplary embodiments that will be described in the following description, in particular: FIG. 1A is a perspective view of a first embodiment of the valve assembly in a fully closed configuration; FIG. 1B is a perspective view of a second embodiment of the valve assembly in a fully closed configuration; FIG. 1C is a sectional view along the A-A plane of a third embodiment of the valve assembly in a fully closed configuration;

FIGS. 2A, 2B and 2C respectively show the valves illustrated in FIGS. 1A-1C in an open configuration, in particular: FIG. 2A shows the first embodiment of the valve assembly of FIG. 1A in a fully open configuration; FIG. 2B shows the second embodiment of the valve assembly of FIG. 1B in a fully open configuration; FIG. 2C shows the third embodiment of the valve assembly of FIG. 1C in a fully open configuration;

FIG. 3A is a front view of the valve assembly, FIG. 3B is a sectional view of the valve assembly along an A-A plane, FIG. 3C is a sectional view of the valve assembly along a B-B plane;

FIG. 4A is a front view of the valve assembly, FIG. 4B is a sectional view of the valve assembly along an A-A plane, FIG. 4C is a sectional view of the valve assembly along a B-B plane;

FIG. 5A is a front view of the valve assembly, FIG. 5B is a sectional view of the valve assembly along an A-A plane, FIG. 5C is a sectional view of the valve assembly along a B-B plane;

FIG. 6A is a front view of the valve assembly, FIG. 6B is a sectional view of the valve assembly along an A-A plane, FIG. 6C is a sectional view of the valve assembly along a B-B plane;

FIG. 7A is a sectional view along the A-A plane of the valve assembly associated with a generic drilling element, FIG. 7B is a sectional view of the valve assembly and drilling element along a B-B plane, FIG. 7C is a front view of the valve assembly and drilling element;

FIG. 8A is a sectional view along the A-A plane of the valve assembly associated with a generic drilling element, FIG. 8B is a sectional view of the valve assembly and drilling element along a B-B plane, FIG. 8C is a front view of the valve assembly and drilling element;

FIG. 10A is a perspective view of the fourth embodiment of the valve assembly in a fully closed configuration; FIG. 10B shows the fourth embodiment of the valve assembly of FIG. 10A in a fully open configuration;

FIG. 11A is a front view of the valve assembly, FIG. 11B is a sectional view of the valve assembly along an A-A plane;

FIG. 12A is a front view of the valve assembly, FIG. 12B is a sectional view of the valve assembly along an A-A plane;

Figure 2A:
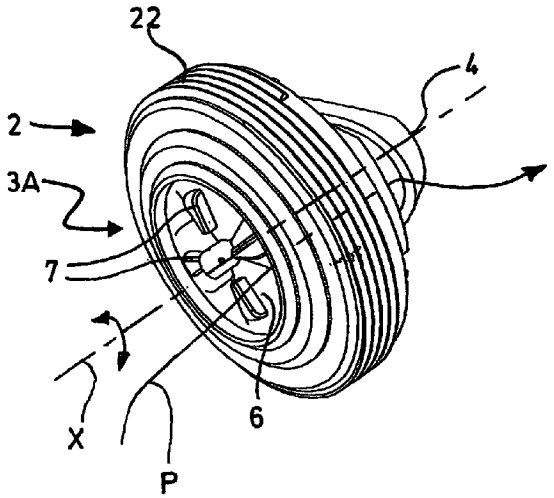

With reference to the above-listed Figures, valve assembly 2 according to the present invention is adapted to selectively open and close a radial aperture 84 provided on a drilling element 8 for drilling mud circulation.

For the purposes of the present invention, the term drilling element 8 refers to any substantially cylindrical device used for drilling an extraction well, which can be inserted into the well itself and which comprises an axial longitudinal hole 82 and a radial aperture 84, e.g. as shown in FIGS. 8A, 8C, 9A and 9B.

Valve assembly 2 according to the present invention comprises a valve body 3, which in turn comprises an inlet aperture 3A and an outlet aperture 3C. Said valve body 3 further comprises a duct 3B for putting said apertures 3A, 3C in communication with each other, thereby defining a mud path "p".

The term mud path "p" refers to the path followed by the drilling mud as it is fed in through radial aperture 84 of drilling element 8, when the same valve assembly 2 is associated with drilling element 8, as is known to a man skilled in the art.

Valve assembly 2 according to the present invention comprises at least two movable shutters 4, 6 arranged in cascade along the direction of the mud path "p", thus forming at least a double barrier.

The exemplary and non-limiting embodiments of valve assembly 2 described below and illustrated in the drawings preferably comprise two shutters 4, 6. In equivalent non-limiting embodiments, said shutters may be more than two, while nevertheless providing the same technical effect.

Preferably, said at least two shutters 4, 6 can move with respect to said valve assembly 2, in particular with respect to valve body 3, but they cannot be removed from valve body 3. Said at least two shutters 4, 6 are movable and stay operationally connected to the valve body, preferably always and constantly over time.

Preferably, in at least one operating configuration said at least two shutters 4, 6 are arranged along one same first axis "X", preferably substantially parallel to the direction of mud path "p", or at least along the same direction.

Preferably, said first axis "X" corresponds to the longitudinal axis of radial aperture 84 comprised in drilling element 8.

Preferably, the shutters comprised in valve assembly 2 according to the present invention form normally-closed valves.

The term normally-closed valve refers to a valve intended for staying closed, thus preventing the passage of a fluid through the duct 3B of the valve body 3; the same valve will only open, thereby allowing the passage of a fluid, if appropriately operated.

In the embodiments shown in the annexed drawings, valve assembly 2 according to the present invention comprises two shutters 4, 6. In particular, it comprises a first shutter 4 and a second shutter 6. Said first shutter 4 is arranged downstream, along mud path "p", with respect to a second shutter 6.

More in detail, said first shutter 4 is arranged in proximity to outlet aperture 3C of valve body 3, preferably in correspondence thereto, and said second shutter 6 is arranged in proximity to said inlet aperture 3A of valve body 3. In the embodiments of FIGS. 1A, 1B e 10A, said second shutter 6 is to be considered as being arranged in correspondence to inlet aperture 3A. As regards the embodiment shown in FIG. 1C, the shutter is to be considered as being arranged in proximity to inlet aperture 3A.

Said second shutter 6 can move with respect to valve assembly 2, in particular with respect to valve body 3, while still remaining operationally connected to valve assembly 2, in particular to valve body 3. In particular, said second shutter 6 is movable, but it remains operationally connected to said valve body 3. In all four exemplary and non-limiting embodiments, the second shutter 6 can be moved while still remaining in the proximity of inlet aperture 3A and operationally connected thereto, i.e. second shutter 6 cannot be removed from valve assembly 2. In particular, there is at least one retaining element 62 that prevents the second shutter 6 from being completely removed or separated from valve body 3.

The second shutter 6 can be operated automatically, e.g. via an automatic or semi-automatic opening element (not shown).

For the purposes of the present invention, the term shutter operation means the action of switching between the different operating configurations of the shutter.

In general, said second shutter 6 comprises at least one hooking element 7 through which said opening element can appropriately activate or deactivate said second shutter 6.

The actuation of said second shutter 6 occurs through a rotational and/or translational movement, e.g. a purely rotational movement, a rotational-translational movement, or a purely translational movement. Upon every movement of said second shutter, the latter always remains operationally connected to valve body 3.

In equivalent, non-limiting embodiments, the actuation of said second shutter 6 is achieved through a complex kinematic movement, which can however provide the same technical effects.

In general, said second shutter 6 comprises a retaining element 62 that allows the second shutter 6 to move between an active or closed configuration, in which it obstructs duct 3B and prevents the passage of drilling mud, and an inactive or open configuration, in which it allows the passage of drilling mud.

Said valve assembly 2 comprises a fastening portion 22 to be fastened to or associated with a drilling element 8. In the embodiments shown in FIGS. 1A and 1B, said fastening portion is a threaded portion. Said fastening portion 22 is, for example, formed on the outer surface of valve body 3, or it is associated therewith as shown in FIGS. 1A, 1B, 2A, 2B, 3A-6C.

Fastening portion 22 is adapted to engage with a complementary threaded portion on the internal edges of the radial aperture 84 of a drilling element 8.

Figure 10B:
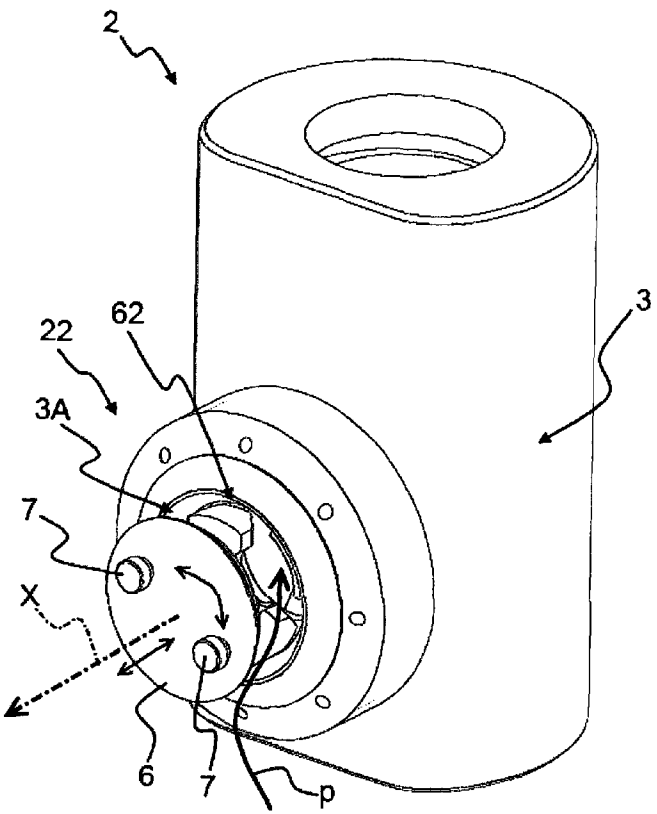
FIGS. 10A and 10B show a preferred fourth embodiment of the valve assembly; in particular.
Figure 10A:
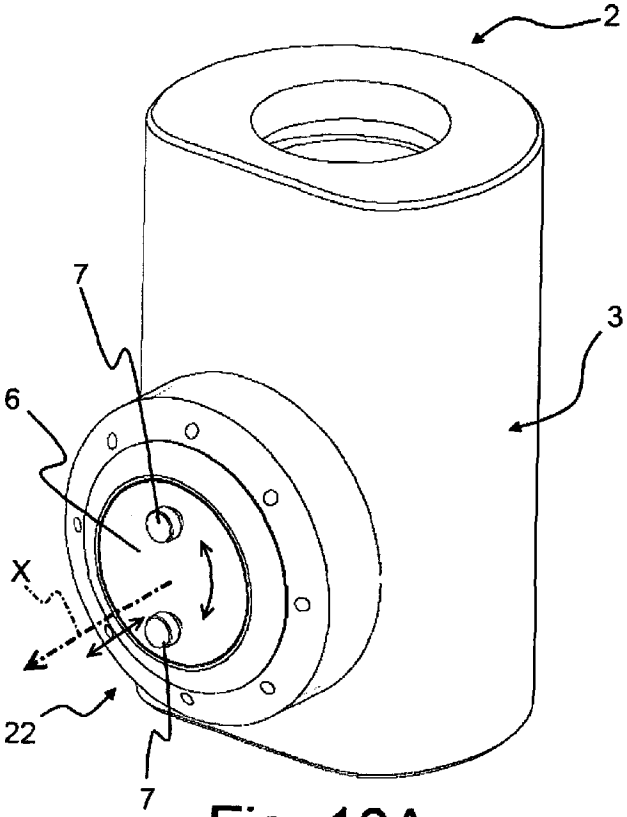

In the embodiments shown in FIGS. 1C and 10A, valve assembly 2 is integrated into the drilling element or associable with a drilling element, e.g. through a fastening portion 22, or it is arranged in series, for example, with a drilling element 8 such as a drill pipe string.

In general, said first shutter 4 is preferably a flap valve.

In particular, said first shutter 4 rotates about an axis of rotation "Y", perpendicular to said first axis "X", along which said first and second shutters 4, 6 are substantially arranged.

Said first shutter 4 is connected to a first retaining element 42, which allows the first shutter 4 to move correctly between the two operating configurations. Preferably, said retaining element 42 retains said first shutter 4 in a closed configuration. In the preferred embodiment, said retaining element 42 is a hinge, more preferably a hinge comprising an elastic element, e.g. a coil spring.

Said axis of rotation "Y" may be parallel to the longitudinal axis of axial longitudinal hole 82 comprised in drilling element 8 with which said valve assembly 2 is associated. In the preferred embodiment, which is however non-limiting, said axis of rotation "Y" is perpendicular to the longitudinal axis of axial longitudinal hole 82 comprised in drilling element 8 with which said valve assembly 2 is associated, as shown in FIGS. 11B, 12B, 13A and 13B.

The following will describe in detail the technical features and principles of operation of three exemplary and non-limiting embodiments of the radial valve.

Equivalent and/or hybrid embodiments should be considered to fall within the protection scope of the present invention.

FIGS. 1A, 2A illustrate a first embodiment of valve assembly 2, wherein said valve body 3 is adapted to house, in proximity to inlet aperture 3A, said second shutter 6. Said inlet aperture 3A comprises at least one first orifice 31A, preferably four of them equally spaced along a circumference, as shown in FIGS. 4A, 4B e 4C. The second shutter 6 comprises as many second orifices 60, which are clearly visible in FIGS. 3A, 4A-4C. Said second shutter 6 is mounted in a rotatable manner, preferably about an axis parallel to said first axis "X", on a second retaining element 62. In the present embodiment, said second retaining element 62 is a pin with which said second shutter 6 is engaged, as shown in FIGS. 3B, 3C, 4B e 4C. Said second retaining element 62 only allows the second shutter 6 to rotate about an axis parallel to said first axis "X", while remaining operationally connected to the valve body. Said second shutter 6 can rotate by a predetermined angle of rotation ranging between 0 and 180°, depending on the number of first and second orifices 31A, 60 included therein.

Said first and second orifices are preferably shaped like a circumference sector, e.g. a shown in FIG. 4A.

The rotation of said second shutter 6 allows said first orifices 31A to be at least partially made to match said second orifices 60, thereby creating a mud path "p" through which drilling mud can flow.

Figure 9A:
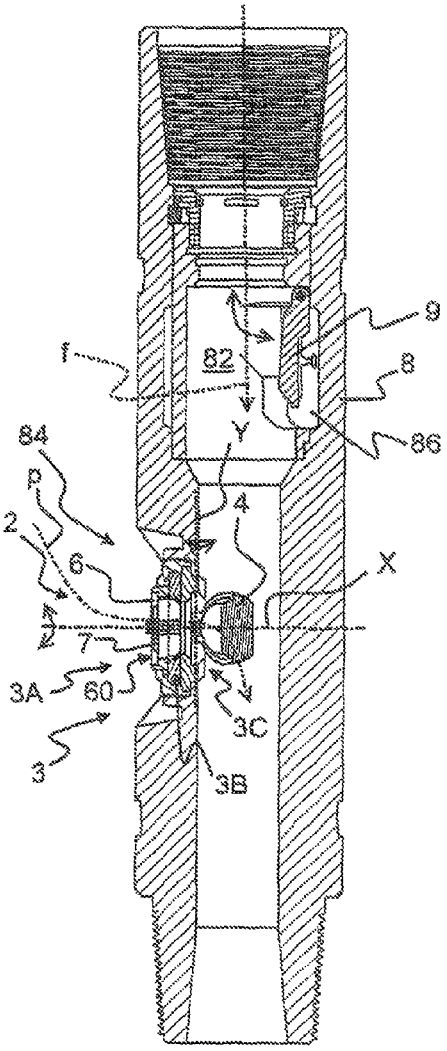
FIGS. 9A and 9B are sectional views of a drilling element with which the valves of FIGS. 2A and 2B are associated.
Figure 9B:
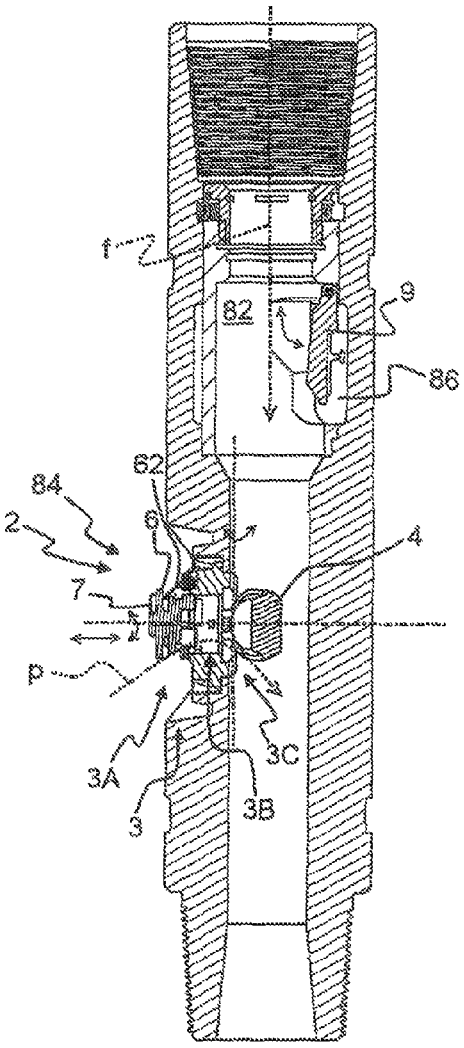

In order to allow the drilling mud to flow in a radial direction relative to a drilling element 8 equipped with valve assembly 2 according to the present invention during the feeding steps, second shutter 6 is turned with respect to the portion of valve body 3 that houses the same second shutter 6. The rotation of said second shutter 6 is such that at least one intake passage or port will be opened. The mud passage section through inlet aperture 3A of valve body 3 is visible in FIGS. 4B, 4C. FIG. 9A shows mud path "p" on a drilling element 8 whereto valve assembly 2 has been applied.

The rotation of said second shutter 6 is actuated by an automatic or semi-automatic opening device.

The first shutter 4, instead, is of the flap type and is normally closed through the effect of a preload of an elastic element, such as a coil spring, comprised in the first retaining element 42, in particular a hinge. Said shutter abuts against a jacket 31C corresponding to outlet aperture 3C of valve body 3.

During the radial feeding step, said first shutter 4 opens through the effect of the thrust exerted by the drilling mud as it flows through.

The axis of aperture of the first shutter 4 is vertical and parallel to the longitudinal axis of through hole 82 of drilling element 8.

At the end of the step of feeding mud through valve assembly 2 located at radial aperture 84 of drilling element 8, the absence of mud will cause the first shutter 4 to close again in abutment with jacket 31C, corresponding to outlet aperture 3C of valve body 3, through the effect of the elastic means, e.g. a coil spring. Subsequently, the automatic or semi-automatic opening device will rotate the second shutter 6 again to reclose the paths or ports previously created, thus returning into the initial closed configuration. The closing of said ports is due to the fact that said first orifices 31A will no longer match said second orifices 60, which are movable relative to said first orifices 31A.

The rotation of said second shutter 6 is due to an opening element that, by engaging with at least one clutching element 7 comprised in said second shutter 6, can rotate between the two operating configurations of said second shutter 6, while still keeping said shutter operationally connected to the valve body.

Preferably, said at least one clutching element 7 is arranged externally to valve body 3, so that it can interact with said opening device, as shown by way of example in FIGS. 1A, 2A, 3A-4C.

Figure 3A:
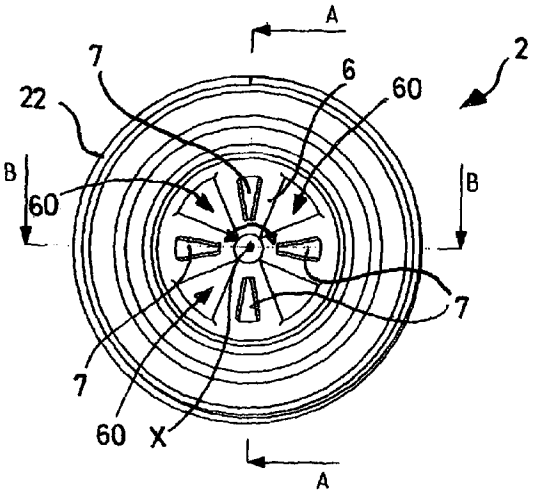
FIGS. 3A, 3B and 3C show different views of the first embodiment of the valve assembly of FIG. 1A; in particular.
Figure 3C:
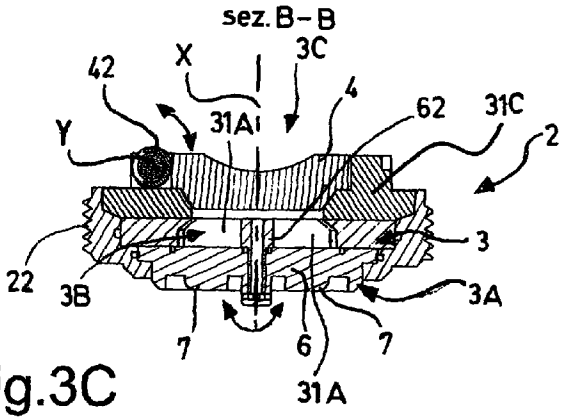
Figure 3B:
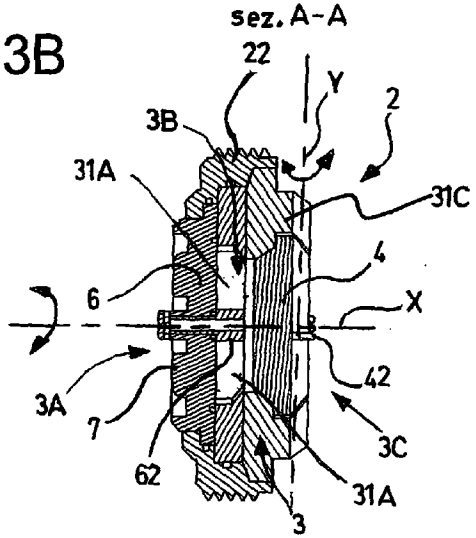
Figure 4A:
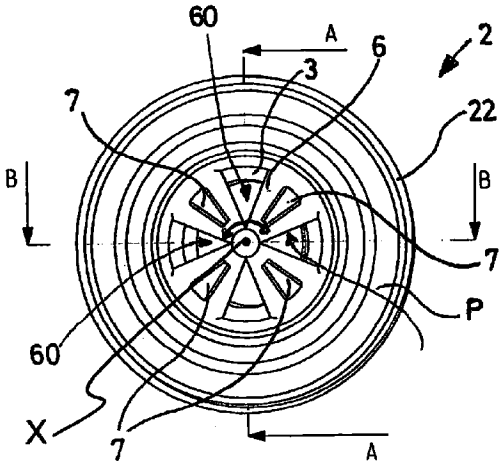
FIGS. 4A, 4B and 4C show different views of the first embodiment of the valve assembly of FIG. 2A; in particular.
Figure 4C:
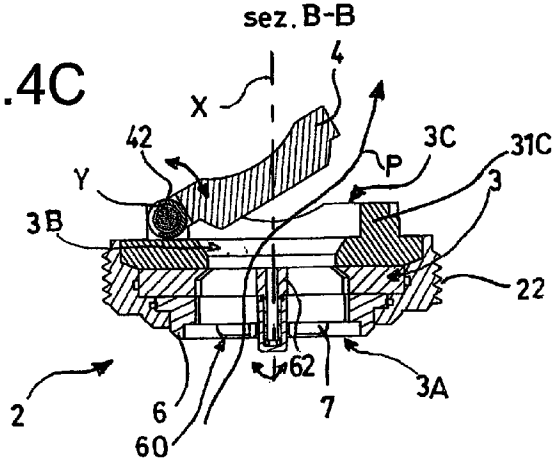
Figure 4B:
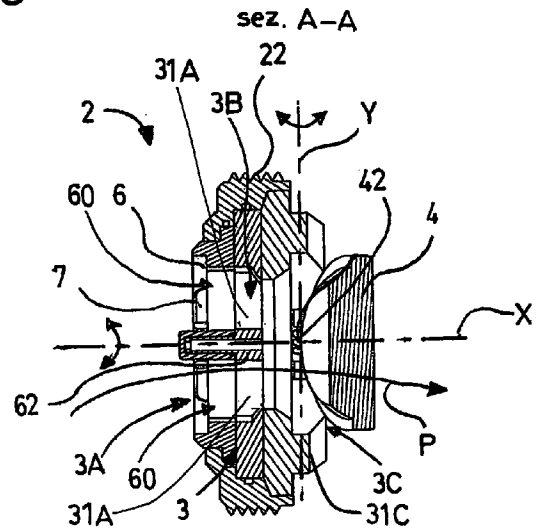

More preferably, there are four of said clutching elements 7 equally spaced along a circumference and alternated with said second orifices 60 along the same circumference, as clearly shown in FIG. 3A, 4A.

Figure 2B:
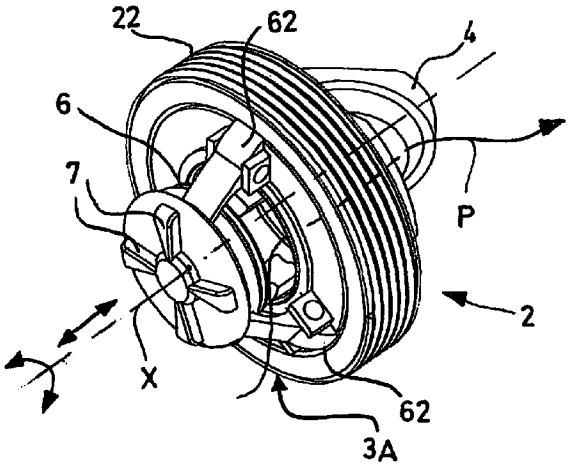

FIGS. 1B, 2B illustrate a second embodiment wherein said valve body 3 is adapted to house said second shutter 6 in proximity to inlet aperture 3A. In the closed operating configuration, said inlet aperture 3A constrains said second shutter 6 both axially and radially. Said second shutter 6 is mounted in a rotatable manner, preferably about an axis parallel to said first axis "X", and can translate by a finite quantity thanks to at least one second retaining element 62, by moving along the same axis "X". In the present embodiment, said at least one second retaining element 62 consists of a plurality of cams fixed at one end to the external edges of inlet aperture 3A of valve body 3, where said second shutter 6 engages, as shown by way of example in FIGS. 5A-6C. Said retaining element can rotate about an axis perpendicular to said first axis "X" in order to allow the translation of the second shutter 6. At the opposite end, said at least one second retaining element 62 cooperates with a housing 61. Said housing 61 is preferably a groove formed in the second shutter 6, as shown in FIGS. 5B, 5C, 6B e 6C. Said second retaining element 62 allows the second shutter 6 to make a translational movement along an axis parallel to said first axis "X". Said second shutter 6 can rotate by a predetermined angle of rotation ranging between 0 and 90°. Said second shutter 6 can translate for a finite length, such that it can come out of the seat of valve body 3 and generate a mud path "p" that allows drilling mud to flow through.

The rotational-translational movement of said second shutter 6 allows the generation of a mud path "p" through which drilling mud can flow.

Said housing 61 cooperates with said second retaining element 62 in such a way as to allow the rotation of the second shutter 6, by allowing the second end of retaining element 62 to slide along the perimeter of housing 61, preferably in a groove. The same housing 61 cooperates with said second retaining element 62 in such a way as to allow the translation of the second shutter, holding the second end of the retaining element and thus defining the maximum translational travel of the second shutter 6, as clearly shown in FIGS. 2B and 6B, without the latter being completely removed.

In order to allow the drilling mud to flow in a radial direction relative to a drilling element 8 equipped with valve assembly 2 according to the present invention during the feeding steps, the second shutter 6 is turned with respect to the portion of valve body 3 that houses the same second shutter 6, and is then extracted, without however being removed, from said seat, e.g. by making a translational movement, preferably along said axis "X", so as to open at least one intake passage or port. The mud passage section through inlet aperture 3A of valve body 3 is visible in FIGS. 6B, 6C.

The rotational-translational movement of said second shutter 6 is actuated by an automatic or semi-automatic opening device.

In this embodiment as well, the first shutter 4 is of the flap type and is normally closed, e.g. through the effect of a preload of an elastic element, such as a coil spring, comprised in the first retaining element 42, in particular a hinge. Said first shutter is normally closed and abuts against a jacket 31C corresponding to outlet aperture 3C of valve body 3.

During the radial feeding step, said first shutter 4 opens through the effect of the thrust exerted by the drilling mud as it flows through.

The axis of aperture of the first shutter 4 is vertical and parallel to the longitudinal axis of through hole 82 of drilling element 8.

At the end of the step of feeding mud through valve assembly 2 located at radial aperture 84 of drilling element 8, the absence of mud will cause the first shutter 4 to close again in abutment with jacket 31C, corresponding to outlet aperture 3C of valve body 3, through the effect of the elastic means, e.g. a coil spring. Subsequently, the automatic or semi-automatic opening device will translate and rotate the second shutter 6 again to reclose the paths or ports previously created, thus returning into the initial closed configuration. The closing of said ports is caused by the obstruction of inlet aperture 3A of valve body 3 by the second shutter 6, after it has been translated and sealingly tightened by its rotation.

The rotational-translational movement of said second shutter 6 occurs thanks to an opening element that, by engaging with at least one clutching element 7 comprised in said second shutter 6, can move said second shutter 6 between the two operating configurations. In particular, said opening element can turn said second shutter 6 and also extract the second shutter 6, without however removing it, from its seat, e.g. by acting upon said at least one retaining element 62 or by exerting a translation force on the second shutter 6 itself.

Preferably, said at least one clutching element 7 is arranged externally to valve body 3, so that it can interact with said opening device, as shown by way of example in FIGS. 1B, 2B, 5A, 6A.

Figure 5A:
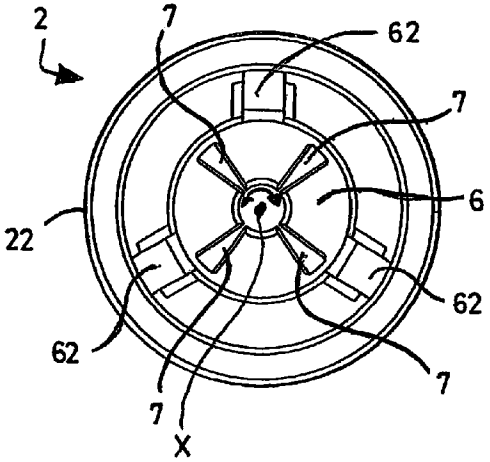
FIGS. 5A, 5B and 5C show different views of the second embodiment of the valve assembly of FIG. 1B; in particular.
Figure 5C:
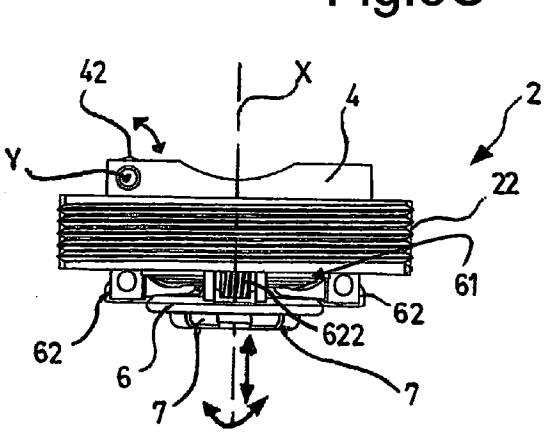
Figure 5B:
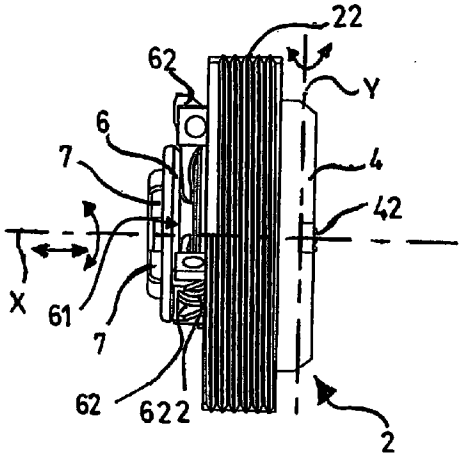
Figure 6A:
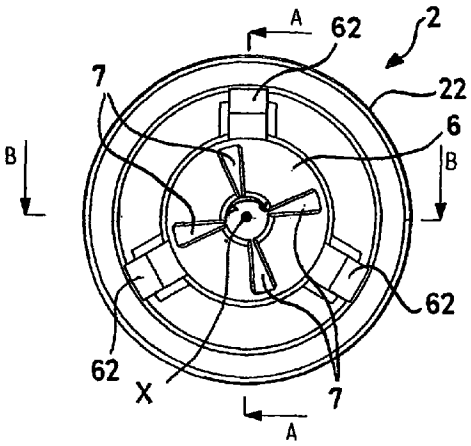
FIGS. 6A, 6B and 6C show different views of the second embodiment of the valve assembly of FIG. 2B; in particular.
Figure 6C:
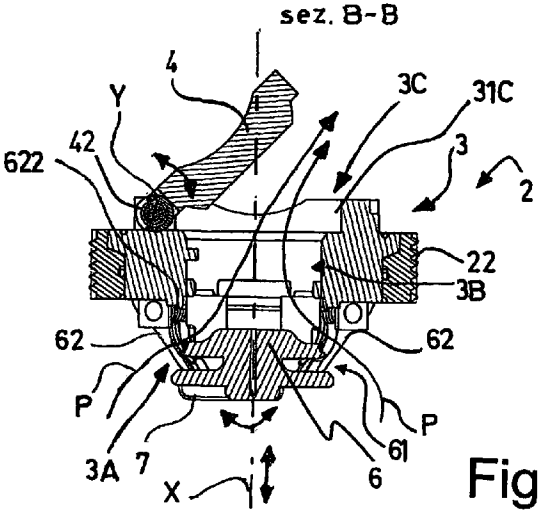
Figure 6B:
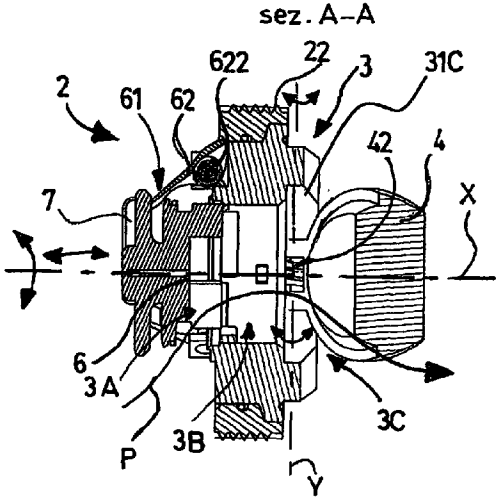

More preferably, there are four of said clutching elements 7, equally spaced along a circumference, as shown in FIGS. 5A and 6A.

Said at least one retaining element 62 preferably comprises an elastic means 622 adapted to hold said second shutter 6 in a desired configuration, e.g. closed.

In the illustrated embodiment, said elastic means 622 acts upon said retaining element 62 in a manner such that, in the absence of any external forces, in particular for extracting the second shutter 6, the same second shutter 6 will obstruct inlet aperture 3A of valve body 3 thanks to a preload of said elastic means 622. This feature significantly improves the efficiency of the closing step and the safety of valve assembly 2 according to the present invention. Said elastic means 622 is preferably a coil spring.

Figure 2C:
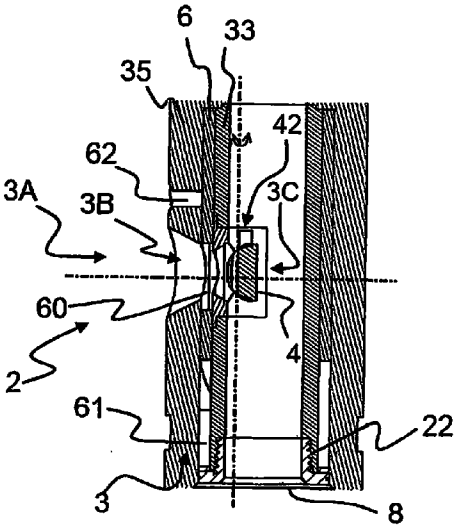

FIGS. 1C, 2C illustrate a third embodiment, wherein said second shutter 6 is adapted to operate in proximity to inlet aperture 3A of valve body 3. In the closed operating configuration, said inlet aperture 3A is obstructed by said second shutter 6, which is positioned between inlet aperture 3A and duct 3B. Said second shutter 6 is, for example, a gate shutter. Said second shutter 6 is mounted in such a way that it can essentially translate or rotate and translate along an axis, preferably along an axis parallel to the axis of rotation "Y" of said first shutter 4, as shown by way of example in FIGS. 1C, 2C, 7A and 8A.

Said shutter 6 translates or rotates and translates in a housing 61, preferably an interspace. Said housing 61 is formed in valve body 3 or between the outer wall of valve body 3 and a wall of a drilling element 8. As shown in the annexed drawings, particularly in FIGS. 7B and 8B, in the present embodiment valve body 3 has a hollow cylindrical shape, thus defining an axial aperture that will match axial aperture 82 of drilling element 8 with which it will be associated. On the inner face there is outlet aperture 3C, whereas inlet aperture 3A is located on the outer face. Said second shutter 6 is arranged coaxial to said valve body 3, so that it can rotate and/or translate with respect to said valve body 3, in particular with respect to an axis parallel to said axis "Y". Preferably, the second shutter 6 is interposed between two portions of valve body 3, in particular between a first portion 33, comprising outlet aperture 3C, and a second portion 35, comprising said inlet aperture 3A. More in detail, as shown in FIGS. 7B and 8B, the first portion 33, the second shutter 6 and the second portion 35 consist of three concentric cylinders. Said second portion 35 may be the very external structure of drilling element 8. Said second shutter 6 can move relative to said two portions 33, 35 of valve body 3.

Said second shutter 6 comprises at least one second orifice 60, preferably only one having a circular shape.

Figure 7C:
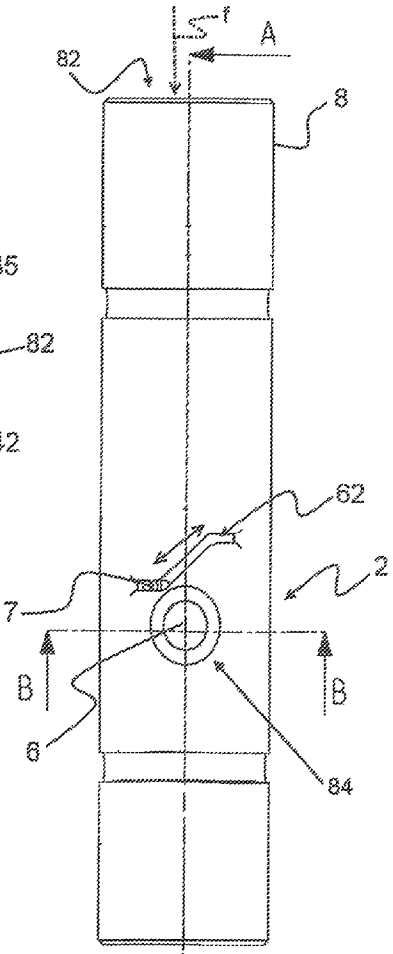
FIGS. 7A, 7B and 7C show different views of the third embodiment of the valve assembly of FIG. 1C; in particular.
Figure 7B:
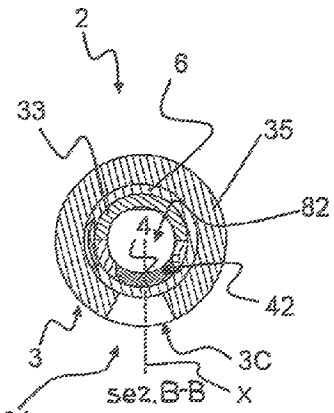
Figure 7A:
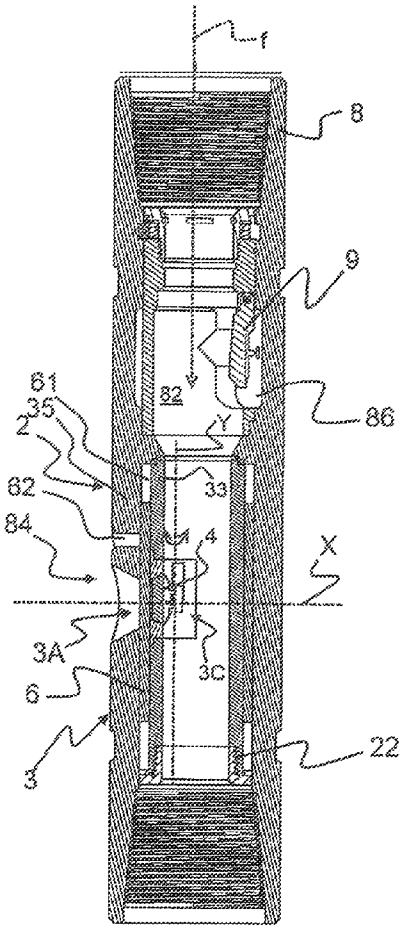
Figure 8C:
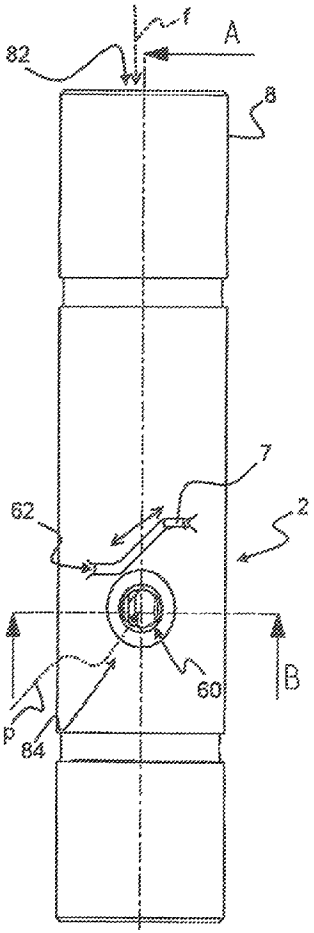
FIGS. 8A, 8B and 8C show different views of the third embodiment of the valve assembly of FIG. 2C; in particular.
Figure 8B:
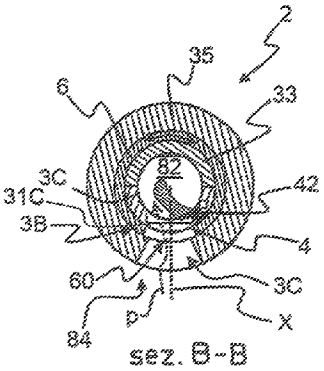

In the present embodiment, said at least one second retaining element 62 is a guide, e.g. made or formed on the second portion 35 of valve body 3, with which hooking element 7 engages, the latter being rigidly fixed to said second shutter 6, as shown in FIGS. 7C and 8C. Said second retaining element 62 is preferably a guide, more preferably a groove, as shown in FIGS. 1C, 2C, 7A and 8A.

Said second retaining element 62 is adapted to guide said hooking element 7 in a manner such that it will translate or rotate and translate about an axis, e.g. perpendicular to said first axis "X", in order to allow the second shutter 6 to translate or rotate and translate along an axis substantially parallel to the axis of rotation "Y". Said translation or rotation-translation allows the second shutter 6 to clear inlet aperture 3A, e.g. by exiting duct 3B, or by matching said second orifice 60 with inlet aperture 3A of valve body 3 and with duct 3B.

Said second retaining element 62 allows the second shutter 6 to make a translational or rotational-translational movement, essentially along an axis parallel to said axis of rotation "Y". In the preferred embodiment, said second shutter 6 rotates by a predetermined angle of rotation ranging between 0 and 90°, and at the same time translates along an axis substantially parallel to said axis "Y", thereby generating a mud path "p" that allows drilling mud to flow through.

Figure 8A:
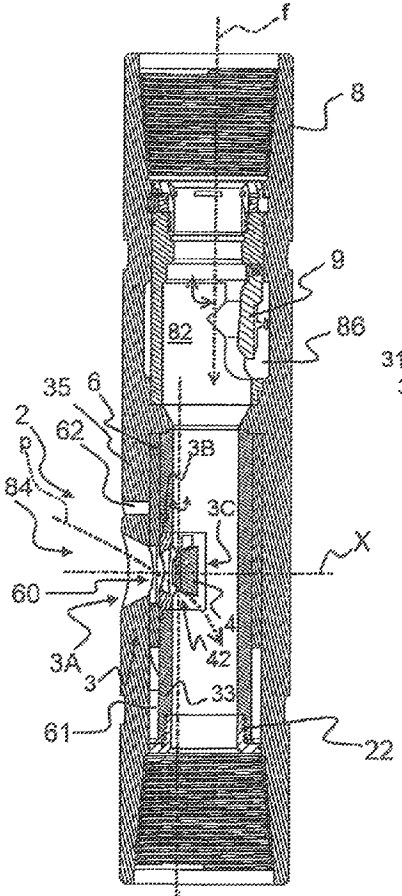

Thanks to the translation or rotation-translation of said second shutter 6, a mud path "p" is generated through which drilling mud can flow, as shown by way of example in FIGS. 1C, 8A and 8B.

The second retaining element 62 is so shaped as to allow moving hooking element 7 for the purpose of allowing the second shutter 6 to switch between the two operating configurations.

As shown in FIGS. 7C and 8C, said retaining element 62 comprises two horizontal section, not aligned with each other and interconnected by a section that is inclined with respect to at least one of them.

Said two horizontal sections respectively allow the second shutter to be kept in an operating configuration, whether open or closed. The inclined section is such that it allows the second shutter 6, via hooking element 7, to translate or rotate and translate. Said retaining element defines the translational or rotational-translational travel of the second shutter 6, as clearly visible in FIGS. 7C and 8C.

In order to allow the drilling mud to flow in a radial direction relative to a drilling element 8 equipped with valve assembly 2 according to the present invention during the feeding steps, the second shutter 6 is translated or rotated and translated with respect to portions 33, 35 of valve body 3 by moving substantially along said axis "Y", so as to open at least one intake passage or port. In particular, said intake passage or port is obtained through the at least partial interface between a second orifice 60 comprised in the second shutter 6 and inlet aperture 3A and duct 3B of the valve body. The mud passage section through inlet aperture 3A of valve body 3 is visible in FIGS. 8A and 8B.

The translational or rotational-translational movement of said second shutter 6 is actuated by an automatic or semi-automatic opening device.

In this embodiment as well, the first shutter 4 is of the flap type and preferably is normally closed, e.g. through the effect of a preload of an elastic element, such as a coil spring, comprised in the first retaining element 42.

All the features of said first shutter 4 described in the above embodiments will also apply to the following embodiment.

At the end of the step of feeding mud through valve assembly 2 located at radial aperture 84 of drilling element 8, the absence of mud will cause the first shutter 4 to close again in abutment with jacket 31C, through the effect of the elastic means. Subsequently, the automatic or semi-automatic opening device will translate or rotate and translate the second shutter 6 again to reclose the paths or ports previously created, thus returning into the initial closed configuration. The closing of such ports is due to the fact that, after the translational or rotational-translational movement, said second orifice 60 will no longer match inlet aperture 3A and duct 3B of valve body 3.

The translation or rotation-translation of said second shutter 6 occurs thanks to an opening element that, by engaging with at least on clutching element 7 comprised in said second shutter 6, can move said second shutter 6 between the two operating configurations. In particular, said opening element can translate or rotate and translate said second shutter 6.

Preferably, said at least one clutching element 7 is arranged externally to valve body 3, but internally with respect to the profile of drilling element 8, so that it can interact with said opening device, as clearly shown by way of example in FIGS. 7C and 8C.

More preferably, said at least one clutching element 7 is only one.

FIGS. 10A, 10B illustrate a fourth embodiment, similar to the second embodiment, wherein said valve body 3 is adapted to house said second shutter 6 in proximity to inlet aperture 3A. In the closed operating configuration, said inlet aperture 3A constrains said second shutter 6 both axially and radially. Said second shutter 6 is mounted in a rotatable manner, preferably about an axis parallel to said first axis "X", and can translate by a finite quantity thanks to at least one second retaining element 62, by moving along the same axis "X". In the present embodiment, said at least one second retaining element comprises at least one guide formed in the valve body, and a pin comprised in said second shutter and adapted to move in said guide (not shown in detail in the drawings). Said retaining element, in particular said at least one guide, allows shutter 6 to rotate about said first axis "X" and then to translate along said axis "X", and vice versa. Said second retaining element thus allows the second shutter 6 to make both a rotational movement and a translational movement along said first axis "X". Said second shutter 6 can rotate by a predetermined angle of rotation ranging between 0 and 90°. Said second shutter 6 can translate for a finite length, such that it can come out of the seat of valve body 3 and generate a mud path "p" that allows drilling mud to flow through.

The rotational-translational movement of said second shutter 6 allows the generation of a mud path "p" through which drilling mud can flow.

Said guide and said pin of the second retaining element cooperate together to allow the second shutter 6 to rotate and translate. Said guide thus defines the rotational and translational travel of the second shutter 6, as can be understood from FIGS. 10A-13B, without it being completely removed.

In order to allow the drilling mud to flow in a radial direction relative to a drilling element 8 equipped with valve assembly 2 according to the present invention during the feeding steps, the second shutter 6 is turned with respect to the portion of valve body 3 that houses the same second shutter 6, and is then extracted, without however being removed, from said seat, e.g. by making a translational movement, preferably along said axis "X", so as to open at least one intake passage or port. The mud passage section through inlet aperture 3A of valve body 3 is visible in FIGS. 10B, 12B and 13B.

The rotational-translational movement of said second shutter 6 is actuated by an automatic or semi-automatic opening device.

In this embodiment as well, the first shutter 4 is of the flap type and is normally closed, e.g. through the effect of a preload, in particular a hinge. Said first shutter 4 is normally closed and abuts against a jacket 31C corresponding to outlet aperture 3C of valve body 3.

During the radial feeding step, said first shutter 4 opens through the effect of the thrust exerted by the drilling mud as it flows through.

The axis of aperture of the first shutter 4 is perpendicular to the longitudinal axis of through hole 82 of drilling element 8 and perpendicular to said first axis "X".

This type of first shutter 4 can be considered to be the preferred embodiment, without however being limiting in nature. This type of first shutter is preferably applicable to all other embodiments of the valve assembly previously described herein.

Figure 13A:
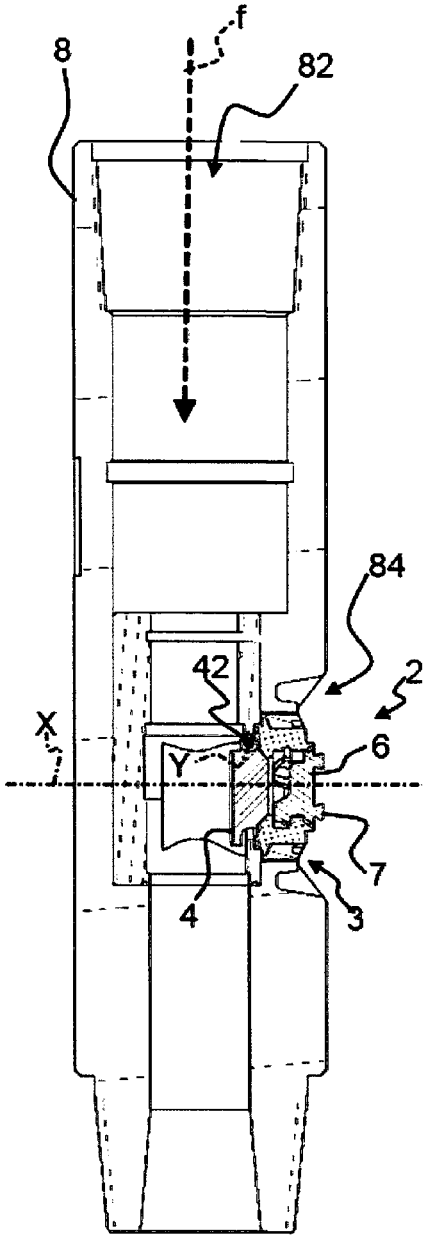
FIGS. 13A and 13B are sectional views of a drilling element with which the valves of FIGS. 10A and 10B are associated.
Figure 13B:
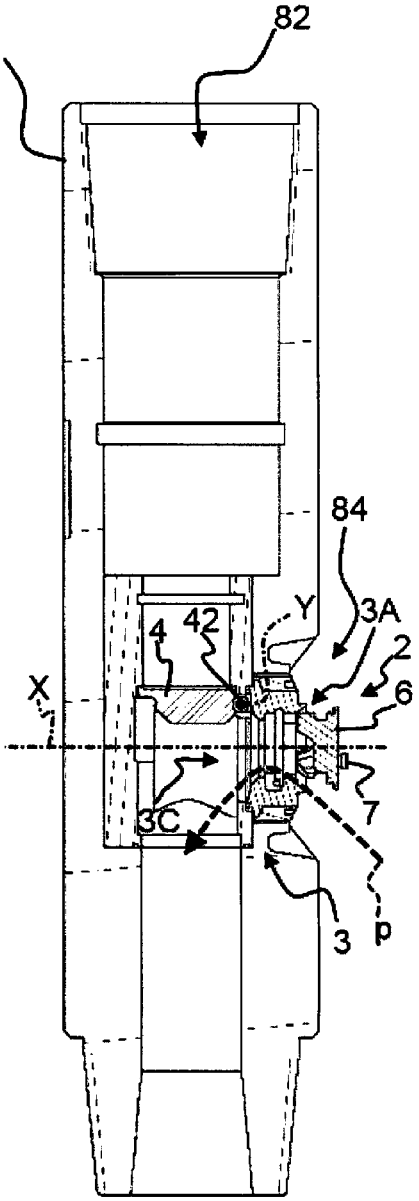

As shown in FIGS. 13A and 13B, the present embodiment advantageously allows the selective closing of through hole 82 and of radial aperture 84, in particular outlet aperture 3C of valve body 3, by means of a single mobile shutter without requiring the use of an additional valve element for closing through hole 82.

Preferably, the first shutter 4 is interposed between two portions of valve body 3, in particular between a first portion 33, comprising outlet aperture 3C, and a second portion 35, comprising said inlet aperture 3A.

At the end of the step of feeding mud through valve assembly 2 located at radial aperture 84 of drilling element 8, the absence of mud will cause the first shutter 4 to close again in abutment with jacket 31C, corresponding to outlet aperture 3C of valve body 3, through the effect of said preload. Subsequently, the automatic or semi-automatic opening device will translate and rotate the second shutter 6 again to reclose the paths or ports previously created, thus returning into the initial closed configuration. The closing of said ports is caused by the obstruction of inlet aperture 3A of valve body 3 by the second shutter 6, after it has been translated and sealingly tightened by its rotation.

The rotational-translational movement of said second shutter 6 occurs thanks to an opening element that, by engaging with at least one clutching element 7 comprised in said second shutter 6, can move said second shutter 6 between the two operating configurations. In particular, said opening element can turn said second shutter 6 and also extract the second shutter, without however removing it, from its seat in valve body 3, e.g. by exerting a pulling force on the second shutter 6 itself.

Preferably, said at least one clutching element 7 is arranged externally to valve body 3, so that it can interact with said opening device, as shown by way of example in FIGS. 10A, 10B, 11A, 12A.

Figure 11A:
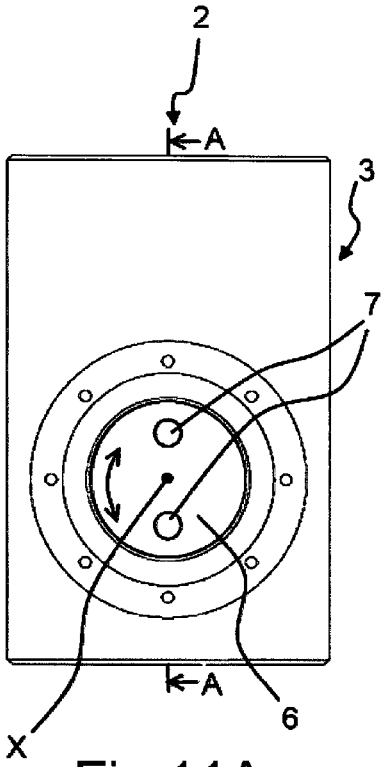
FIGS. 11A, 11B show different views of the fourth embodiment of the valve assembly of FIG. 10A; in particular.
Figure 11B:
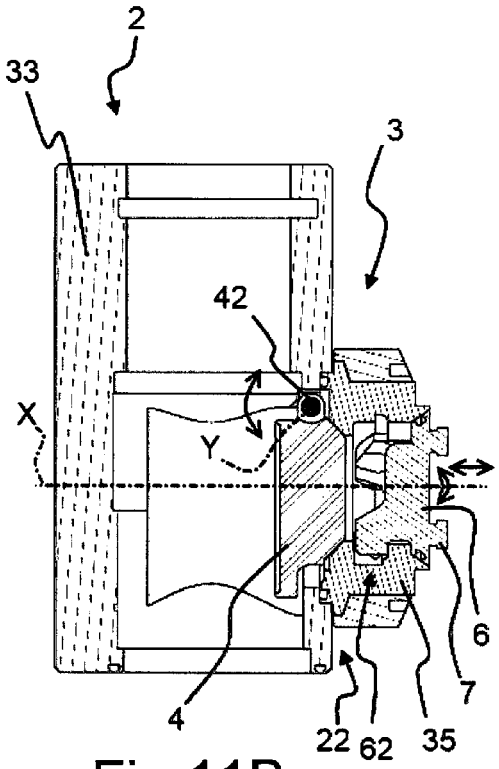
Figure 12A:
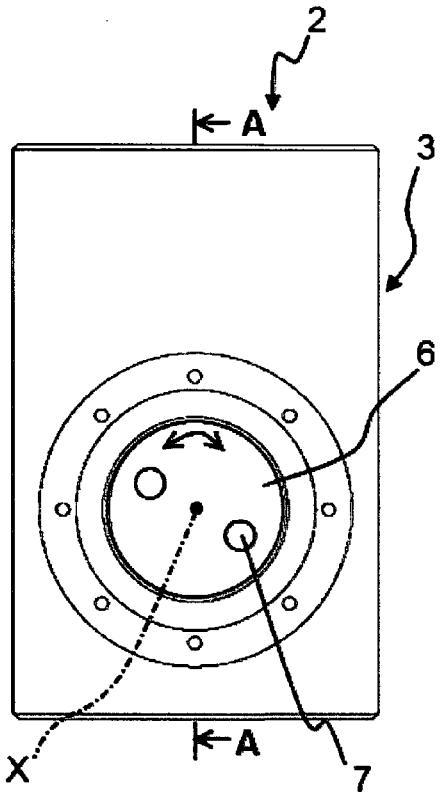
FIGS. 12A, 12B show different views of the fourth embodiment of the valve assembly of FIG. 10B; in particular.
Figure 12B:
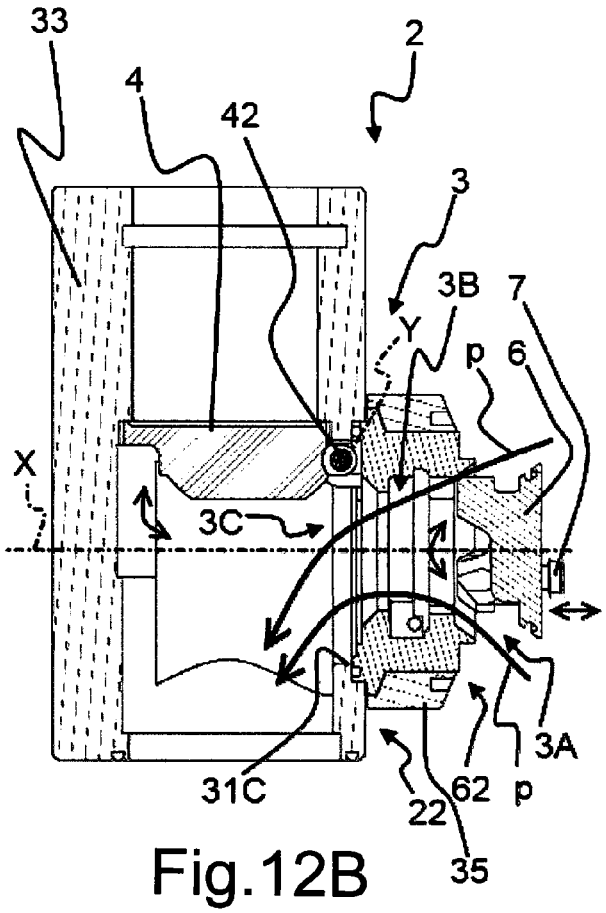

More preferably, there are two of said clutching elements 7, equally spaced along a diametral direction, as shown in FIGS. 11A and 12A.

In all embodiments, said mobile second shutter 6 always remains associated with said valve body 3, without being removed from said valve body.

Said drilling element 8 has a substantially cylindrical shape and, as aforementioned, comprises an axial longitudinal hole 82 and a radial aperture 84, with which a valve assembly 2 according to the present invention is associated.

Said drilling element may comprise an axial valve 9, located in correspondence to the axial longitudinal hole 82. Said axial valve 9 is preferably a flap valve adapted to obstruct the flow of drilling mud in an axial direction, in particular opposite to a mud circulation "f" when said valve assembly 2 is open for mud circulation through radial aperture 84, along mud path "p". The mud circulation "f" is shown by way of example in FIGS. 7A, 9A, 9B. In the open configuration, said axial valve positions itself into a housing 86 comprised in the walls of axial hole 82 of the same drilling element 8.

In the preferred embodiment, said drilling element does not include an axial valve at axial longitudinal hole 82, as shown in FIGS. 13A e 13B. As aforesaid, said axial hole 82 is advantageously closed by means of said first shutter 4 of the valve assembly according to the present invention. In fact, when said first shutter 4 opens said outlet aperture 3B, it is the shutter itself that obstructs the flow of drilling mud in an axial direction, in particular opposite to a mud circulation "f" when said valve assembly 2 is open for mud circulation through radial aperture 84, along mud path "p". Mud circulation "f" is shown by way of example in FIGS. 13A and 13B.

Valve assembly 2 according to the present invention can operate at working pressures of 51711 kpa, with a drilling mud flow rate ranging between 3,500 and 4,000 liters per minute.

Valve assembly 2 according to the present invention and drilling element 8 with which said valve assembly 2 is associated can improve safety during the drilling process, aiming at safeguarding the people's life, the environment, and the devices used during the drilling operations.

Valve assembly 2 is applicable to any drilling element and can be used for all oil well drilling activities.

Valve assembly 2 is applicable, by way of non-limiting example, for drilling operations employing 11.4 cm, 12.7 cm, 14 cm and 14.9 cm diameter drill pipes and 16.8 cm, 17.8 cm, 18.4 cm and 19.1 cm diameter drilling elements 8.

Valve assembly 2 is also applicable, by way of non-limiting example, for drilling operations employing 6⅝" diameter drill pipes and 20.3 cm, 21 cm and 21.6 cm drilling elements 8.

Valve assembly 2 according to the present invention allows keeping the mud flow directed as desired by the operator and prevents any backflow of drilling mud.

The possibility of ensuring continuous circulation during the drilling process and of keeping the pressure constant at the bottom of the well also during pipe changes offers the following advantages:

- it ensures better cleaning of the hole from drilling debris and better stability of the formation, since the walls of the hole being drilled are not subject to stresses caused by pressure variations due to the mud circulation pump being turned on and off, resulting in fewer repair services needed on the drilling battery and less non-productive time (NPT);
- it eliminates the "balloning" effect and facilitates the detection of a possible entry of layer fluids into the well, so that the problem can be solved quickly and safety is considerably improved;
- it allows "near balance" drilling, i.e. drilling with a mud weight close to the gradient of the formation pores, thereby facilitating the achievement of well targets that may be unattainable when using standard technologies;
- it reduces drilling time and costs.

Valve assembly 2 according to the present invention allows the passage, within the battery of drill pipes, of one or more tools necessary for checks or interventions that might be required during the making of the wellbore, also allowing unscrewing or even cutting a drill pipe in the well.

REFERENCE NUMERALS

Valve assembly 2
Fastening portion 22
Valve body 3
Inlet aperture 3A
First orifice 31A
Duct 3B
Outlet aperture 3C
Jacket 31C
First portion 33
Second portion 35
First shutter 4
First retaining element 42
Second shutter 6
Second orifice 60
Housing 61
Second retaining element 62
Elastic means 622
Hooking elements 7
Drilling element 8
Axial hole 82
Radial aperture 84
Housing 86
Axial valve 9
Mud path "p"
First axis "X"
Axis of rotation "Y"

The invention claimed is:

1. Valve assembly for selectively opening and closing a radial aperture provided on a drilling element for drilling mud circulation;

said valve assembly comprises a valve body comprising an inlet aperture and an outlet aperture, and a duct for putting said apertures in communication with each other, and defining a mud path;

said valve assembly comprising at least two shutters arranged in cascade along a direction of the mud path, forming at least a double barrier arranged along one same first axis and form normally-closed valves;

wherein a first shutter is arranged downstream, along the mud path with respect to a second shutter;

wherein:

said at least two shutters remaining operatively connected to said valve body to prevent complete removal of said at least two shutters with respect to the valve body;

actuation of said second shutter occurs through a rotational-translational movement; and said first shutter comprises a flap valve.

2. The valve assembly according to claim 1, said second shutter comprising at least one retaining element preventing the second shutter from being completely removed or separated from the valve body.

3. The valve assembly according to claim 2, wherein said second shutter is automatically actuatable.

4. The valve assembly according to claim 2, wherein said at least one retaining element allows the second shutter to move between an active or closed configuration in which said at least one retaining element obstructs the duct and prevents passage of drilling mud, and an inactive or open configuration, in which said at least one retaining element allows the passage of the drilling mud.

5. The valve assembly according to claim 1, wherein said second shutter comprises at least one hooking element, through which an opening element can activate or deactivate said second shutter.

6. The valve assembly according to claim 1, comprising a fastening portion to be fastened to or associated with a drilling element.

7. The valve assembly according to claim 1, wherein said first shutter rotates about an axis of rotation which is perpendicular to a first axis along which said first and second shutters are substantially arranged, wherein said axis of rotation is parallel to the longitudinal axis of an axial longitudinal hole comprised in a drilling element with which said valve assembly is associated.

8. A drilling element having a substantially cylindrical shape and having an axial longitudinal hole and a radial aperture formed therein, wherein the valve assembly according to claim 1 is associated therewith at the radial aperture.

9. The drilling element according to claim 8, comprising an axial valve arranged in correspondence to the axial longitudinal hole.

* * * * *